US005445415A

United States Patent [19]

Campbell

[11] Patent Number: 5,445,415

[45] Date of Patent: Aug. 29, 1995

[54] IN-LINE ROLLER SKATE WHEELS COVER

[76] Inventor: Greg Campbell, 2313 32nd St., Los Angeles, Calif. 90405

[21] Appl. No.: 355,472

[22] Filed: Dec. 14, 1994

[51] Int. Cl.[6] ..... A63C 3/12

[52] U.S. Cl. ..... 280/825; 280/11.22; 36/132

[58] Field of Search ..... 280/825, 11.22, 809, 280/811; 36/115, 132, 134, 7.5, 15; 150/154

[56] References Cited

U.S. PATENT DOCUMENTS

| | | | |
|---|---|---|---|
| 1,406,657 | 2/1922 | Knizek | 36/132 |
| 3,861,697 | 1/1975 | Dolce . | |
| 4,045,890 | 9/1977 | D'Alessandro et al. | 36/132 |
| 4,123,854 | 11/1978 | Pasich | 36/132 |
| 4,355,474 | 10/1982 | Grim | 280/825 |
| 4,364,187 | 12/1982 | Melendez | 280/825 |
| 4,413,842 | 11/1983 | Loredo | 280/825 |
| 4,896,439 | 1/1990 | Morgan | 36/115 |
| 5,183,292 | 2/1993 | Ragin, III | 280/825 |
| 5,236,224 | 8/1993 | Anderson et al. | 280/825 |
| 5,290,065 | 3/1994 | Kassal | 280/825 |
| 5,303,955 | 4/1994 | Zurnamer | 280/825 |
| 5,359,789 | 11/1994 | Bell | 36/7.5 |

FOREIGN PATENT DOCUMENTS

| | | | |
|---|---|---|---|
| 2065834 | 10/1993 | Canada | 280/825 |

*Primary Examiner*—Karin L. Tyson
*Assistant Examiner*—Carla Mattix
*Attorney, Agent, or Firm*—Hoffman, Wasson & Gitler

[57] ABSTRACT

A flexible cover for releasable attachment over the wheels of an in-line roller skate which is portable, flexible, and can be easily stored. The device contains an elongated holding channel for engagement with the wheels of an in-line skate along with a mechanism to allow the user to easily store the device during non-use.

3 Claims, 6 Drawing Sheets

IN-LINE ROLLER SKATE WHEELS COVER

BACKGROUND OF THE INVENTION

Field of the Invention

The present invention relates to a cover for the wheels of an in-line roller skate. In particular, the invention is a portable cover for the wheels of an in-line roller skate for immobilizing the wheels and protecting the wheels of the skate. Once in place, the cover will allow the individual to walk freely on a smooth surface. Once disengaged, the unique cover will facilitate storage by wrapping same around ones body.

With the increasing popularity of in-line roller skating there is a real need for such a portable cover. Many businesses forbid roller skaters on their premises, and therefore the skaters must remain outside of such areas or remove the skates before entering them. Such regulations are unsatisfactory for both the skater and business men. The skater is frustrated and the business man is disappointed by the loss of potential customers.

It thus, is desirable for skaters to be provided with some form of device that mounts easily and quickly to the in-line roller skates to immobilize the wheels and provide a walking surface, thereby allowing the skater to walk while wearing the skates. In addition, the device must easily store so that the skater when back skating will not be encumbered by a lumbering device.

A cover for the wheels of a roller skate is taught by Grim in U.S. Pat. No. 4,355,474. The patent addresses the problem of covering the wheels of a conventional roller skate. Grim teaches a sheet type cover which hook to the end of the skate structure mounting, covering the spaced pairs of wheels with a flat, rectangular sheet. The sheet cover provides a surface or sole in which a skater may walk, when not on the skating rink. The roller skate sole of the patent is not practical for use on a roller blade skate because of the wheel alignment of the skate. Further, the Grim teaching addresses the problems of covering wheels on conventional roller skates, taking into account that the conventional roller skate has a wheel arrangement that provides a rectangular, almost square, area with which to work with.

Kassal discloses a roller blade skate wheel cover in U.S. Pat. No. 5,290,065. This patent addresses an in-line skate configuration but provides a bulky device which when removed is cumbersome to store, and is not easily adjustable for varying lengths of skates. There is an adjustment feature whereby the second bridal can be re-positioned. A screw must be loosened and the positioned changed manually. This is all cumbersome and not easy for one to do in a hurry.

Anderson et al, U.S. Pat. No. 5,236,224 relates to a walker attachment for in-line skates. The device is a solid cumbersome piece which snaps on to an in-line blade to allow one to walk on a level surface. Again, once a device is removed it is cumbersome to hold and further, the device has no adjustability feature which can be instantaneously employed.

Ragin III, U.S. Pat. No. 5,183,292 addresses a way to provide a pad which will allow one to walk on a surface while wearing a roller in-line roller skate type configuration. The pad can be somehow attached in a cumbersome way to the boot of the device or actually worn when the skates are removed as sandals. Again, this device is not easily storable and not easily adjustable without the removal of varying screw configurations.

SUMMARY OF THE INVENTION

The present invention provides a novel flexible cover which can be easily attached over the wheels of an in-line roller skate for immobilization of the wheels. The flexible cover receives the tandem lined wheels of an in-line skate in a holding channel and prevents rotation of the wheels by immobilization thereof. Strap extensions, which extend from the actual elongated holding channel which immobilizes the wheels, are provided. One end of the strap extensions can be wrapped around the leg of an in-line skate wearer and the other strap extension has at least one eyelet which facilitates engagement with a cooperating hook-like device attached to the first strap extension which is wrapped around a users leg. A number of eyelets can be provided so that the device can be tightened or loosened pursuant to the user specifications, and further the length of the strap extension which extends around a users leg is easily adjustable by threading same through a loop which has been provided at the end of the strap extension.

The wheel retaining or holding channel has an inside wall-to-wall dimension which approaches the thickness of in-line skate wheels. Further, it can be nests for the wheels to mate with to prevent rotation thereof, or sliding in the channel. The channel is preferably made from a rubber or rubberized material. However, other materials or combination of materials may be used, as desired. The holding channel receives, covers, and retains the lower portion of the wheels of the skate, in the groove of the channel. The base of the channel provides an inner surface and next, if desired for each wheel, to support the wheels and an outer surface on which the person wearing the skates may walk.

The strap extension portions can also be made of a rubberized or somewhat flexible material to allow for a more secure fit.

The loop, provided at the end of one of the extensions, through which the elongated length of strap extension is threaded can be any rigid material, and preferably a metallic ring. The hook which is attached to the elongated length of strap extension around which ones leg is wrapped, can either float on the extension or be fixed securely to the extension. The hook device is made of any suitable stable structural material. Any metallic material is suitable though not required.

It is an object of the invention to provide a cover for the wheels of an in-line roller skate that immobilizes the wheels of an in-line skate.

It is another object to provide a cover for the wheels of an in-line roller skate that will permit a user to walk safely, with the skate on the foot of the walker.

It is another object of the invention to allow for a cover for the wheels of an in-line roller skate to be easily stored around a body part, if desired, when not in use.

It is another object of the invention to make the cover for an in-line roller skate easily adjustable to compensate for varying skate sizes, and leg diameters.

These and other object's will become more apparent when reading the following detailed description with reference to the accompanying drawings.

DETAILED DESCRIPTION OF THE PREFERRED EMBODIMENT

In describing the invention with reference to the drawings, identical components shown throughout the drawings have identical element numbers, for convenience.

Figure 1:
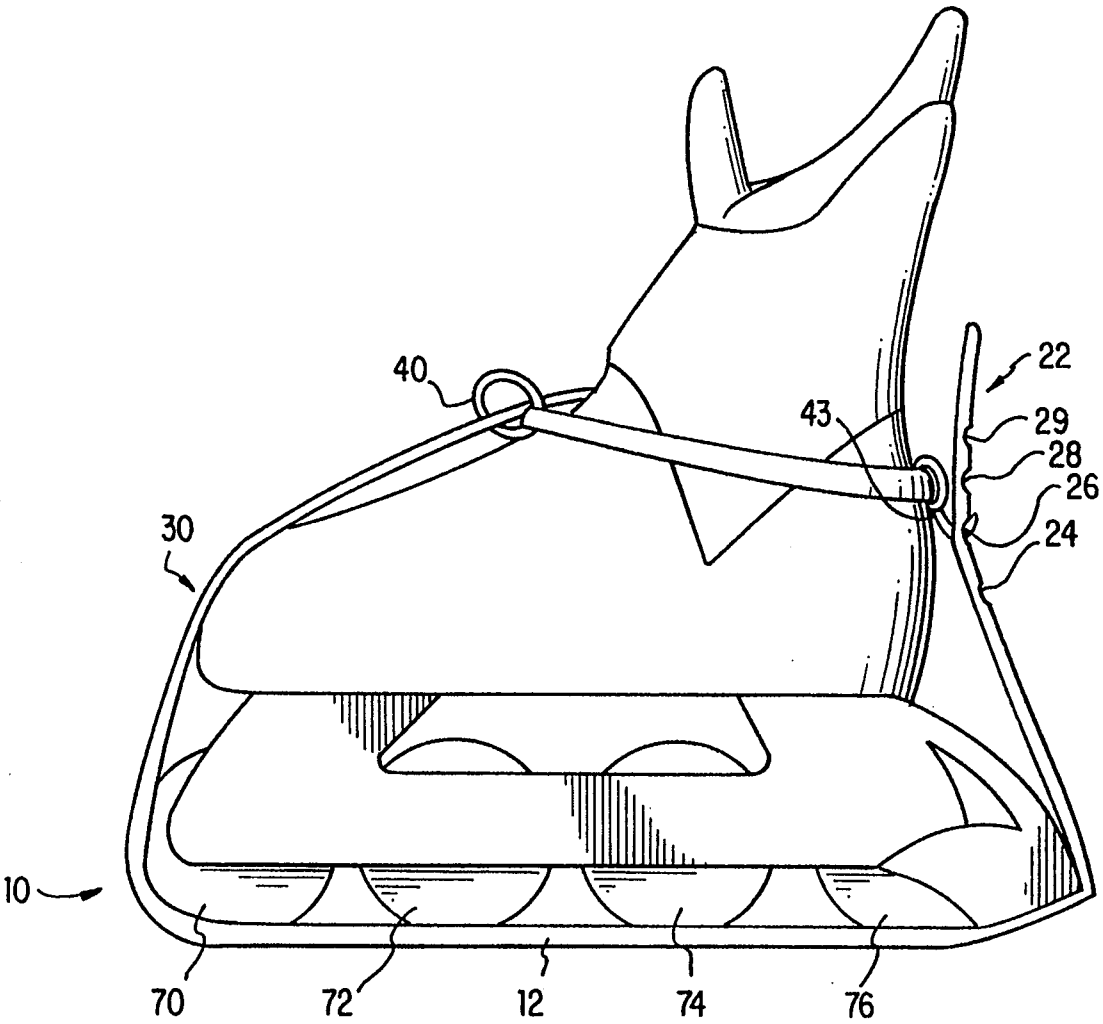
FIG. 1 is a pictorial view of an embodiment of the invention in use on an in-line roller skate.
Figure 2:
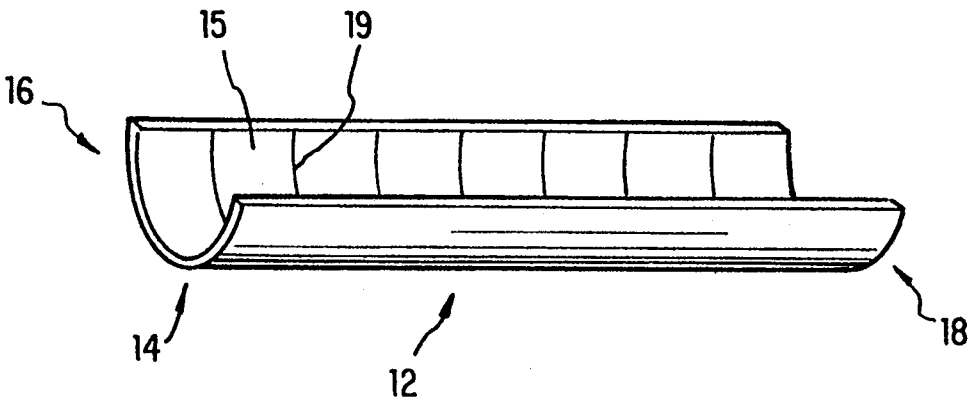
FIG. 2 is a perspective view of a portion of the elongated holding channel in an embodiment of the invention.

Referring to FIGS. 1 and 2, an in-line roller skate cover is depicted 10. The flexible in-line roller skate cover contains a tubed or grooved rubber elongated holding channel 12 having a base portion 14 and Side walls 16 and 18 for receiving a plurality of wheels (70, 72, 74, 76). The holding channel 12 can have a smooth top portion 15 or one which contains nests or ribs which immobilize each wheel of an in-line skate See FIG. 2, where the top portion of the Base portion 14 of the elongated holding channel portion is depicted as a plurality of ribs. The bottom side of the base portion can be ribbed or smooth as per the user's desire to allow for walking on varying surfaces. Further, one can attach supplemental treads to the bottom side of the base portion 14 to provide desired traction surfaces. FIG. 2 is depicted with one type of treading 20 for example. The elongated holding channel has a leading end with a first strap extension 22 having a plurality of eyelets 24, 26, 28 and 29. As desired and required, at least one eyelet is required, but a plurality is preferred. The strap extension 22 is made of a flat flexible material, such as rubber. The trailing end of said elongated holding channel 12 has an extended of strap extension 30 connected thereto made up of a flat flexible material, such as rubber. At the end of the extended strap extension 30, there is attached a loop or ring means 40 for engagement of the extended strap extension 30, itself. The loop or rings means 40 can be made of any type of material flexible or rigid and preferably is a metallic type ring. Further, any means for engaging strap extension 30 in a connecting manner to circle a portion of a users leg is contemplated by the invention. On the strap extension 30 there is attached a hook means 43 either in a fixed attached or on sliding ring for ultimate engagement with the eyelets 24, 26, 28 and 29 contained on the short strap extension 22.

Figure 3:
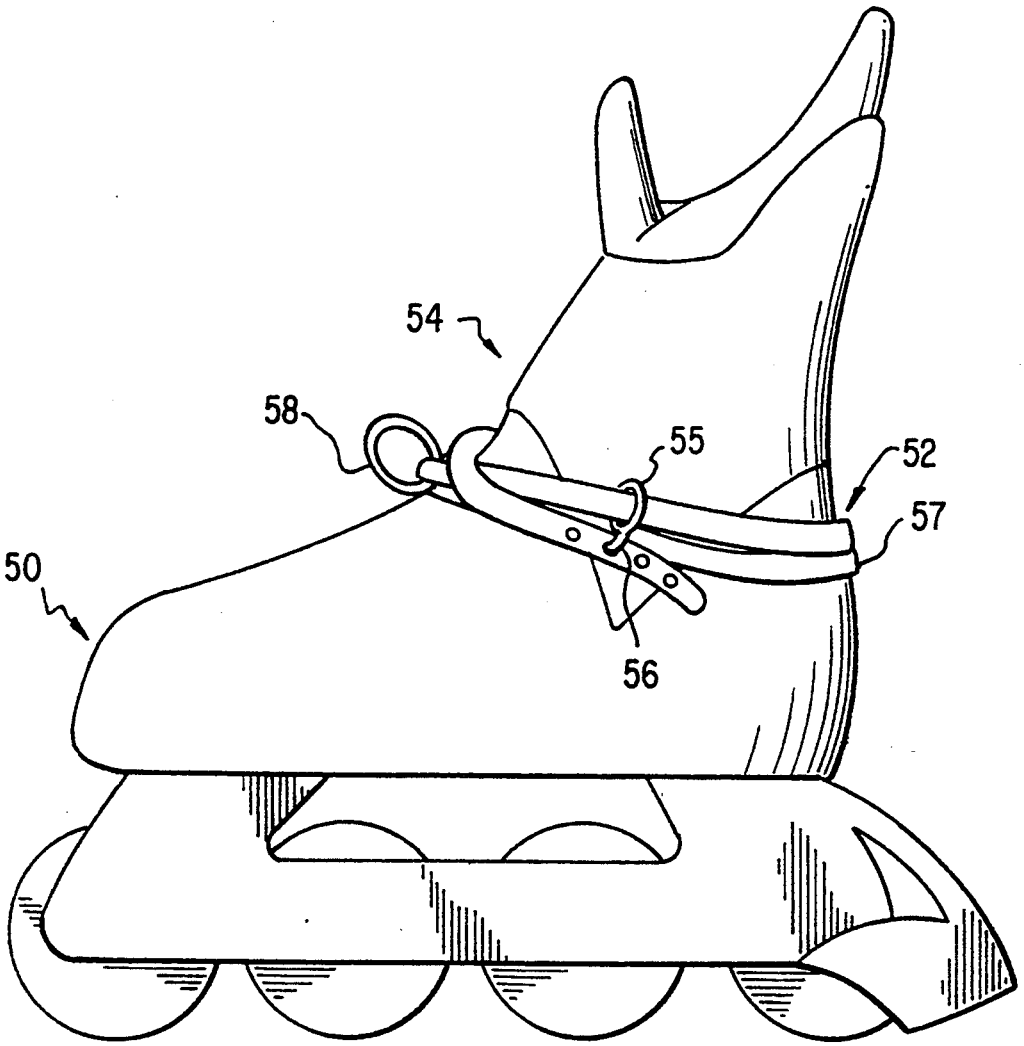
FIG. 3 is a pictorial representation of an embodiment of the invention in storage on an in-line roller skate.

Referring to FIG. 3, an in-line roller skate 50 is depicted. An in-line roller skate wheel cover 52 is displayed in storage on the skate cuff 54. Hook means 55 is in engagement with eyelet 56. The holding channel 57 has been fed through ring or loop means 58 at least one time to facilitate storage.

Figure 4:
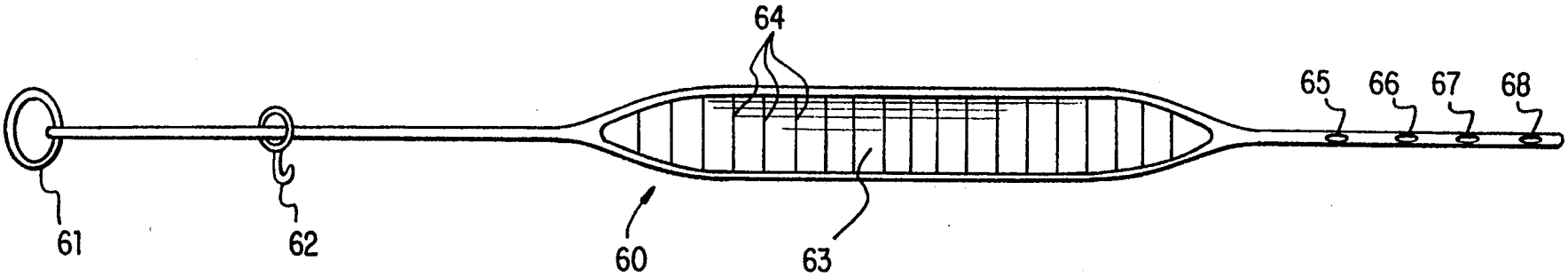
FIG. 4 is a top view of an embodiment of the invention.
Figure 5:
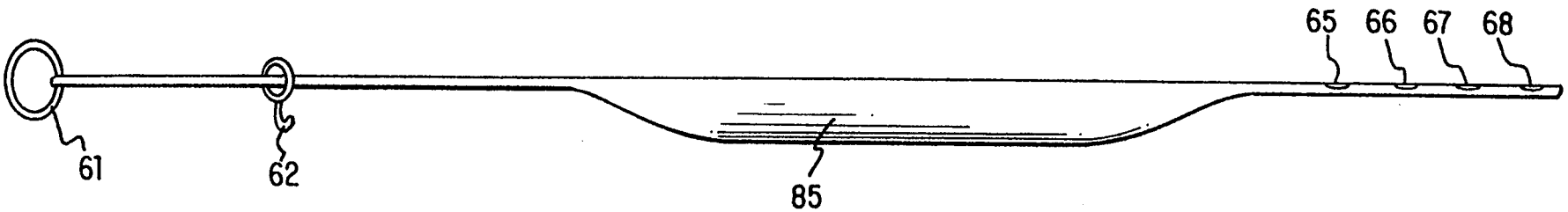
FIG. 5 is a side view of an embodiment of the invention.

FIG. 4 depicts the in-line roller skate cover 60 from a top view. Depicted are loop or ring means 61, hook means 62, the elongated holding channel 63 having a plurality of ribs 64, and a plurality of eyelets 65, 66, 67 and 68. FIG. 5 similarly discloses an embodiment of the invention from a side view. Elongated holding channel 85 is depicted as having a depth which will engage a plurality of in-line skate wheels. Reference numerals from FIG. 4 have been used to depict like components of the device.

Figure 6A:
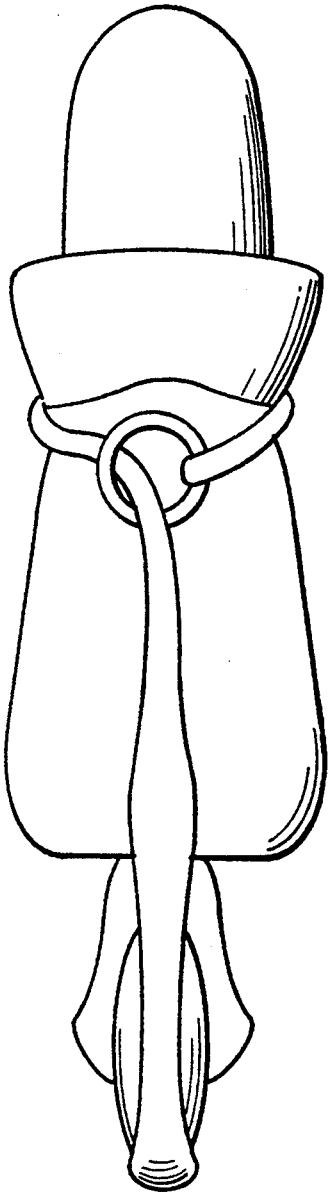
FIGS. 6A and 6B depict an embodiment of the in-line skate wheel cover from the front and back, respectively.
Figure 6B:
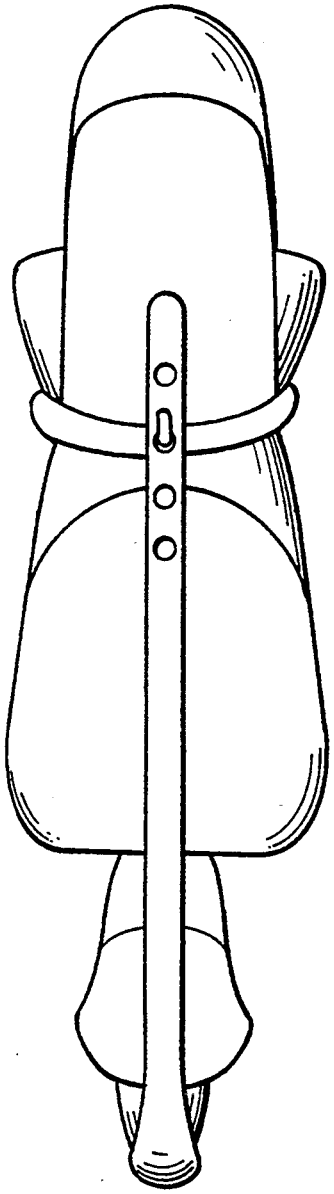

FIGS. 6A and 6B depict the in-line roller skate cover in engagement with a skate from the front and back, respectively.

A preferred embodiment of the invention has been represented and described. Other changes and modifications, as may become apparent to those skilled in the art, made be made without departing from the invention.

What is claimed is:

1. A flexible cover for releasable attachment over the wheels of an in-line roller skate, said cover comprising:

a) an elongated holding channel having a leading end and a trailing end and a base having side walls for receiving a plurality of wheels of said in-line skate;

b) said leading end of said elongated holding channel having a first strap extension extending therefrom, said first strap extension having at least one eyelet contained therein;

c) said trailing end of said elongated holding channel having a second strap extension extending therefrom, said second strap extension having a loop means attached to the end of said second strap extension; and d) a hook means attached to said second strap extension for engagement with said at least one eyelet on said first strap extension;

e) said elongated holding channel and said first and second strap extensions being of a flexible, one piece construction.

2. A flexible cover for releasable attachment as recited in claim 1, wherein said base of said elongated holding channel has a first side for engaging said wheels and a second side for engaging a surface to be walked upon, said second side having a tread pattern placed thereon to allow for ease of walking.

3. A flexible cover for releasable attachment as recited in claim 1, wherein said base of said elongated holding channel has a first side for engaging said wheels and a second side for engaging a surface to be walked upon, said first side having at least one rib or nest to immobilize said wheels of an in-line roller skate.

* * * * *